United States Patent [19]

Swain

[11] Patent Number: 4,983,102

[45] Date of Patent: Jan. 8, 1991

[54] SELF-ENCLOSED FILTER PUMPING SYSTEM

[76] Inventor: Danny C. Swain, 1124 Foxhurst Way, San Jose, Calif. 95120

[21] Appl. No.: 257,768

[22] Filed: Oct. 14, 1988

[51] Int. Cl.[5] ..... F04B 43/06

[52] U.S. Cl. ..... 417/394; 417/313; 417/479

[58] Field of Search ..... 417/394, 395, 478, 479, 417/480, 313

[56] References Cited

U.S. PATENT DOCUMENTS

| | | | |
|---|---|---|---|
| 3,298,320 | 1/1967 | Latham, Jr. | 417/395 X |
| 4,278,085 | 7/1981 | Shim | 417/477 X |
| 4,382,753 | 5/1983 | Archibald | 417/479 |
| 4,479,761 | 10/1984 | Bilstad et al. | 417/479 X |
| 4,642,098 | 2/1987 | Lundquist | 417/388 X |
| 4,690,621 | 9/1987 | Swain | 417/395 X |

*Primary Examiner*—Leonard E. Smith
*Assistant Examiner*—Eugene L. Szczecina, Jr.
*Attorney, Agent, or Firm*—Michael J. Hughes

[57] ABSTRACT

A self enclosed filter pump system (10) is provided to deliver precise quantities of selected fluids. The system (10) includes a pump assembly (12) of a pneumatically controlled type and a modular filter and fluid bag assembly (14) adapted to mate with the pump assembly (12) during use. The filter and fluid bag assembly (14) is a flexible component which includes a container portion (20) for storing enclosed fluid (16) and an extension portion (22) for mating with the pump assembly (12). A series of fluid flow passages (35) create a fluid flow path from the storage chamber (34) to a first value bubble (36), a pump/filter bubble (46), a second valve bubble (52) and an outlet port (56). A filter membrane (48) may be secured within the pump/filter bubble (46) to filter the fluid (16) to remove particulate matter. The various bubbles (36, 46 and 52) are occluded and opened by pneumatic pressure applied to matching chambers (78, 88 and 94) in the pump housing (62). The filter and fluid bag assemblies (14) are adapted to isolate the fluid (16) from the pump assembly (12), to be constructed to have a variety of storage chamber (34) capacities, to contain any of a wide variety of selected fluids (12) and to be modularly interchangeable such that a wide variety may properly operate with a single pump assembly (12). The primary expected usages of the pump system (10) are in the semiconductor manufacturing, chemical mixing, biomedical and food processing fields.

20 Claims, 4 Drawing Sheets

SELF-ENCLOSED FILTER PUMPING SYSTEM

TECHNICAL FIELD

The present invention relates generally to fluid pumping devices and more particularly to devices adapted to filtering particulate matter from input fluid during the pumping process. The preferred embodiment of the present invention is specifically adapted for providing a prefilled disposable filter pump bag assembly which mates with a pump assembly in a modular replaceable manner to form a pumping and filtering system which delivers precise quantities of ultrapure or highly filtered liquids to selected destinations.

DESCRIPTION OF THE PRIOR ART

Modern chemical, biomedical, food processing techniques and other applications frequently require precise dispensation of carefully controlled fluids for various process steps. One area of technology in which fluid dispensation is particularly critical is the semiconductor manufacture industry. In this industry, it is very common for process steps to require input of carefully measured quantities of highly reactive chemicals in liquid form. It is also frequently critical to ensure that the fluids are not contaminated with particulate matter prior to delivery. For this reason, filtration of the fluids can be a necessary step.

Heretofore, in most cases, transport, pumping, dispensation and filtration have been separate process steps performed independently by separate apparati. This has required multiple device interfaces during the transfer step. This has also led to problems with incompatible interfaces, cumbersome space utilization, trapped gas bubbles and other problems inherent in non-unitary devices.

One prior art device which attempts to combine the filtration and pumping/dispensation steps is described in U.S. Pat. No. 4,483,665 issued to H. Hauser on Nov. 20, 1984. This device utilizes separate components to accomplish the filtration and the pumping but mates them together into a single unit. The device utilizes separate valving for the two components. The pumping mechanism utilized in the Hauser device is the common bellows type of pump with the filter unit located separately from the bellows.

A method of pumping fluids which has been particularly adaptable for highly reactive or ultra pure materials is pneumatic diaphragm pumping. This method incorporates pneumatically operated valving utilizing pneumatic pressure or, alternatively, vacuum, to open and close valve elements. The combination of this technology with flexible diaphragms constructed of non-reactive materials, particularly Teflon TM, permits pumping and dispensation of highly reactive fluids in a precise and safe manner.

A particularly effective pumping system is found in the inventor's own prior patent entitled "Filter Pump Head Assembly" shown and described in U.S. Pat. No. 4,690,621, issued Sept. 1, 1987. In the teachings of this invention, a filter unit is incorporated into a pneumatically operated diaphragm type pump in such a manner that the filter could be easily removed for cleaning or replacement.

One of the possible disadvantages of any sort of pump device in which the fluid is passed through permanent fixtures is that a certain amount of the fluid will always be lost during the cleaning of a filter, a replacement of the filter, or change of liquids process. This can be very important not only in situations where the fluids to be pumped are particularly costly but also if they are especially caustic, in which the case the exposure of the fluids to the workers can cause health dangers. Furthermore, prior art methods of pumping fluids, by shipping the fluids in an original container and then passing them through the pumping system to the point of use, create a transfer step through an intermediate vessel. Transfer steps will always have inherent possibilities of leakage at the connection points. In order to maximize efficiency and minimize leakage it is desirable to eliminate connections and transfer steps as much as possible.

BRIEF DESCRIPTION OF THE INVENTION

It is therefore an object of the present invention to provide a system for pumping and filtering fluids in a self-enclosed manner.

It is another object of the present invention to incorporate a pump mechanism which may be utilized with modular self-enclosed fluid pump bags so that the same pump shell may be used to deliver a wide variety of different fluids.

It is another object of the present invention to provide a mechanism whereby the nature or type of fluid being pumped by a particular pump shell may be rapidly and easily changed without leakage or required cleaning steps.

It is a further object of the present invention to provide a system in which manufacturers may prepackage highly caustic, easily contaminated or expensive fluids in small, usable quantities.

It is still another object of the present invention to provide a filtration pumping system in which the filtration capacity of the filter membrane is matched to the quantity of fluid to be delivered therethrough.

The present invention is a self-enclosed filter pump system including a pumping shell adapted to mate with any of several interchangeable filter and fluid bag assemblies in order to pump or control the dispensation of fluid from the fluid bag assembly to a desired output location. The invention is particularly well adapted for applications such as semiconductor manufacturing techniques wherein highly caustic and highly valuable need to be dispensed in a precise manner. It is also particularly well adapted to biomedical processes, chemical mixing, food processing and any other operation in which filtered, isolated fluids are required for precise delivery.

Briefly, a preferred embodiment of the present invention is a self-enclosed filter pump system which is adapted for pumping fluids of various natures. The pump system includes a pump assembly which is adapted to receive and operate with interchangeable filter and fluid bag assemblies. The pump assembly includes a first shell half and a second shell half having a central pump cavity and a pair of valve cavities aligned in matching fashion on each of the halves. The pump assembly is adapted to be easily opened and/or secured in a closed position by the user.

The filter and fluid bag assembly includes a fluid bag portion which is adapted to flexibly enclose the desired quantity of fluid and a filter pump extension portion which is adapted to mate with the pump assembly so as to effectively control the flow of fluid from the bag portion to an outlet. The outlet may be directly delivered to the fluid destination or may be connected to a tubing system or other delivery subsystem. The extension portion includes fluid flow passages and a pair of valve volumes surrounding a central pumping and filtering volume. The entire filter and fluid bag assembly is constructed of a flexible impervious substance such as Teflon#.

An advantage of the present invention is that the fluid container, filter and pump flow path are all situated within the same self-contained element such that the fluid never touches any of the permanent operational pump components.

Another advantage of the present invention is that it eliminates any need for rebuilding the pump whenever it is desired to change the fluid being pumped or to replace the filter.

A further advantage of the present invention is that all movable parts are entirely a part of the disposable bag assembly.

Still another advantage of the present invention is that the filter may be selected to have capacity precisely equal to the volume of fluid to be dispensed therethrough and there is no danger of the user overworking the filter.

A still further advantage of the present invention is that a substantial quantity of the pumping force may be provided by gravity.

Yet another advantage of the present invention is that the pneumatic control system allows for very precise manipulation of the fluid flow.

A still further advantage of the present invention is that the flexible bag assembly, with collapsible walls in the fluid chamber, prevents the inflow of gaseous material into the fluid or the pump and filter element. This allows the pumping of fluids which are volatile or reactive to air and also avoids interruption of the pump operation by the introduction of air bubbles into the passages.

These and other objects and advantages of the present invention will become clear to those skilled in the art upon a review of the following specification, the accompanying drawings and the appended claims.

BEST MODE OF CARRYING OUT THE INVENTION

The preferred embodiment of the present invention is a self-enclosed filter pump system adapted for delivering precisely controlled quantities of filtered fluids to preselected destinations. The invention is adapted for use in a wide variety of applications including semiconductor manufacturing, biomedical applications and food processing. The invention is adapted so that the producer and/or packager of the fluid may provide it to the end location already contained within a disposable portion of the filter pump system so that the end user need never handle the fluid until such time as it has been pumped to the desired destination.

Figure 1:
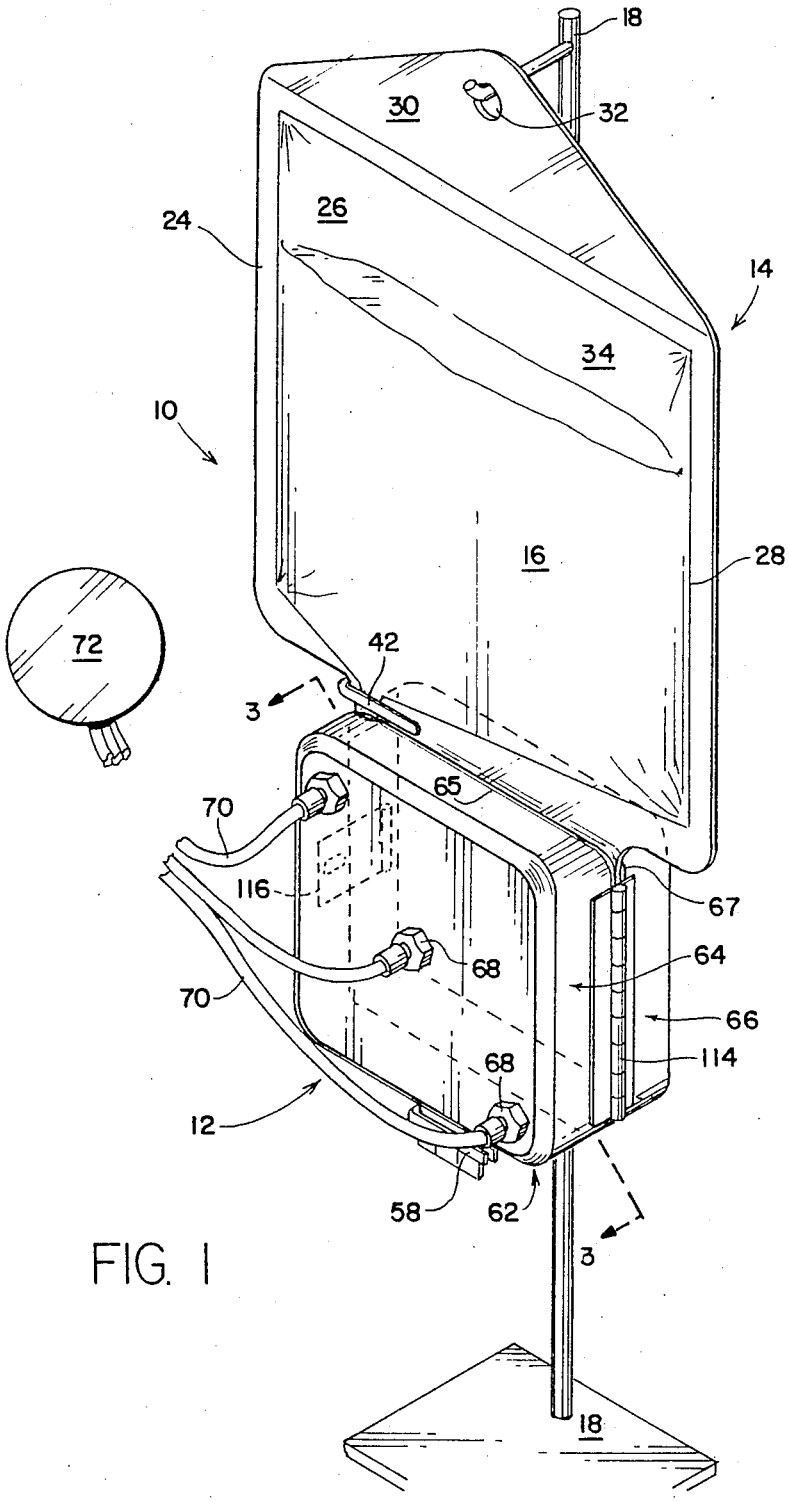
FIG. 1 is a perspective view of a preferred embodiment of the self-enclosed filter pump system of the present invention shown in operational orientation.

Referring now to FIG. 1, the self-enclosed filter pump system of the present invention is shown in a perspective view and designated by the general reference character 10. In this illustration it may be seen that the self-enclosed filter pump system 10 includes a pump assembly 12 and a filter and fluid bag assembly 14. These two separate components operate together to form the pump system 10. The filter and fluid bag assembly 14, when new, comes filled with a preselected quantity of fluid 16 which is to be pumped to whatever desired destination the user may select. The fluid delivery mechanism is aided substantially by hanging the filter and fluid bag assembly 14 from a hanger fixture 18, a generic example of which is illustrated in FIG. 1.

Figure 2:
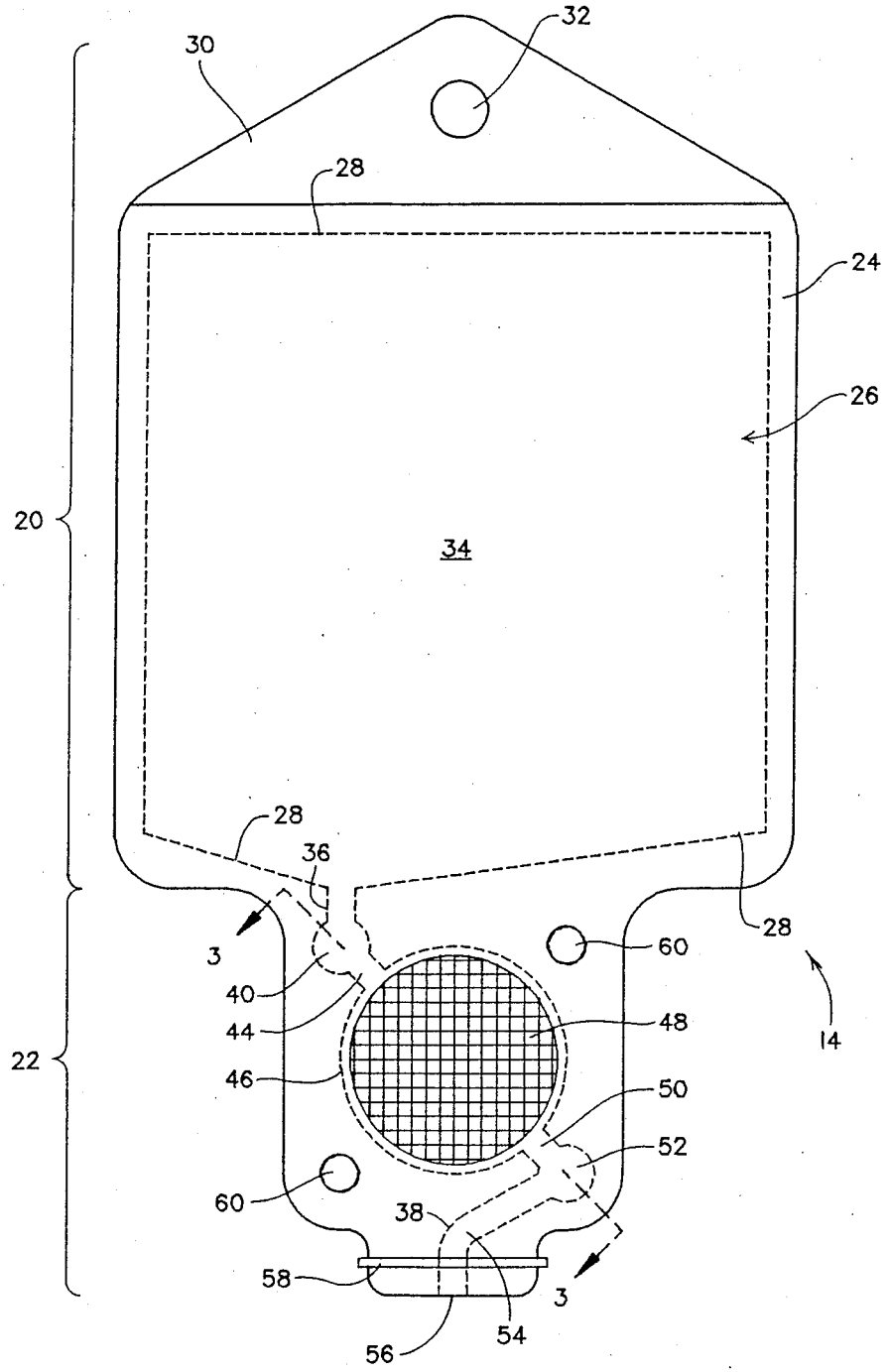
FIG. 2 is a top plan view of the filter and fluid bag assembly portion of the present invention.

As is best understood from a view of both FIG. 1 and FIG. 2, the filter and fluid bag assembly 14 includes a container portion 20, in which the selected fluid 16 is enclosed prior to dispensing, and an extension portion 22 which is adapted to mate with and be substantially contained within the pump assembly 12. The outer surface of the filter and fluid bag assembly 14 is constructed of a bag wall 24, which is a pliant structural material such as polyethylene which will typically be transparent or translucent. A bag liner 26 is attached to the inside surface of the bag wall 24 by a series of welds 28. The bag liner 26 is also a pliant material that is selected to be impervious to the particular selected fluid 16 to be contained within the filter and fluid bag assembly 14. For most purposes this material is selected to be TEFLON TM because of the superior flexibility and degradation resistance of this material.

A hanger flap 30 is formed at one end of the container portion 20. The hanger flap 30 includes a hanger aperture 32 so that the bag assembly 14 may be effectively hung from the hanger fixture 18. The hanger flap 30 is ordinarily a portion of the bag wall 24.

Within the container portion 20, the bag wall 24 and the interior bag liner 26 are enlarged to form an interior volume in the nature of a storage chamber 34 which receives the selected fluid 16. The volume of the storage chamber 34 is selected to contain the desired amount of fluid 16 which is to be delivered in any single filter and fluid bag assembly 14. The bag wall 24 and bag liner 26 are particularly required to be flexible in the area of the storage chamber 34 such that when fluid is pumped out of the storage chamber 34 the walls will collapse inward to prevent the creation of a vacuum which would adversely affect the delivery of fluid to the desired destination point. In this, the container portion functions in a manner similar to that of the blood and plasma bags utilized in medical applications.

From the fluid storage chamber 34 the fluid 16 enters a series of fluid flow passages 35 contained within the extension portion 22. The fluid flow passages 3$ provide the pathway for the fluid 16 to flow through the pump assembly 12 and to a first valve 36, a pump zone 37 and a second valve 38, which are utilized to control the flow of the fluid 16 from the bag assembly 14 to the desired destination.

Figure 3:
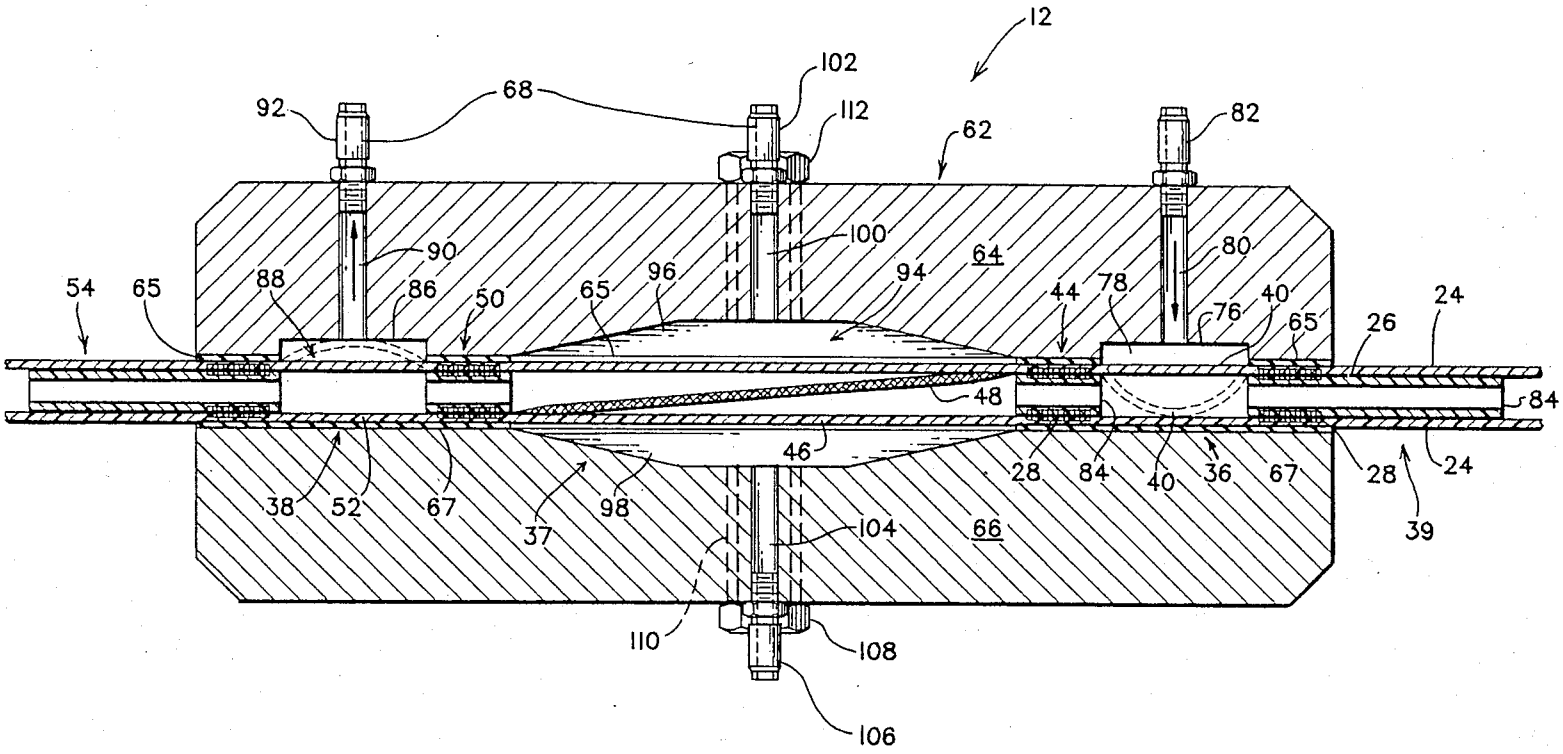
FIG. 3 is a cross-sectional view taken along line 3—3 of FIGS. 1 and 2 showing the pump extension portion of the filter and fluid bag assembly and the surrounding pump shell.

A first passage segment 39 connects the storage chamber 34 to a first valve bubble 40, situated at the first valve 36, discussed in more detail with regard to FIG. 3. As seen in FIG. 1, a first fluid restriction clamp 42 may be placed on the first passage segment 38 in order to prevent fluid flow therethrough. The first fluid restriction clamp 42 will ordinarily be in place during shipment and storage of the bag assembly 14 to prevent the fluid 16 from entering the various fluid flow passages 35.

A second passage segment 44 extends between the first valve bubble 40 and a pump/filter bubble 46, which is centrally located at the pump zone 38 within the extension portion 22. The pump/filter bubble 46 is a substantially larger bubble than the first valve bubble 40 and includes therewithin a filter membrane 48 which is adapted to remove particulate matter, colloidal suspensions and impurities from the fluid 16 during the pumping operation.

A third passage segment 50 connects the pump/filter bubble 46 to a second valve bubble 52, similar to the first valve bubble 40, situated in the area of the second valve 38. A fourth passage segment 54 extends from the second valve bubble 52 to an outlet port 56 which may be positioned directly at the desired fluid destination point or may be connected to further external piping or tubing for delivery. A second fluid restriction clamp 58 may be placed on the fourth passage segment 54 in order to prevent leakage when the pump is not in use or at any other time when it is desired that no fluid is to reach the outlet port 56.

In the preferred embodiment of the filter and fluid bag assembly 14, illustrated in FIG. 2, a pair of fastener apertures 60 are formed in the bag wall 24 to permit the vertical passage of fastener components such as bolts (see FIG. 3), if these are desired in order to hold the pump assembly 12 in a closed and operational position.

The interaction of the bag assembly with the pump assembly 12 is best understood from the cross-sectional view of FIG. 3. This illustration, taken in a cross-sectional view along lines 3—3 of FIGS. 1 and 2, illustrates the manner in which the extension portion 22 of the bag assembly 14 fits and operates within a pump housing 62 of the pump assembly 12.

The pump housing 62 includes a first pump half 64 with an associated first gasket 6$ and a second pump half 66 with an associated second gasket 67. In the illustration of FIG. 3, the first pump half 64 is shown as the upper portion while the second pump half 66 will be the bottom portion of the pump assembly 12. In operation the pump housing will ordinarily hang below the storage chamber 34 and the pump halves will be oriented side-by-side. The pump halves 64 and 66 are substantially solid blocks of material of choice of manufacture. They may be formed of metal or of rigid plastic or any other suitable materials as are desired by the manufacturer. Since the pump housing 62 never comes into direct contact with the fluid 16 it is not necessary that the housing material have any particular properties with respect to the chosen fluid 16.

The molded, preformed top and bottom gaskets 6$ and 67 are provided intermediate the two pump halves for the purposes of positioning and cushioning the extension portion 22. The shapes of the gaskets 6$ and 67 are congruent and essentially correspond to the shaping of the extension portion 22, with the gaskets 6$ and 67 being cut out along the fluid flow passages 6$. This enables the gaskets 6$ and 67 to serve as pneumatic seals for the first and second valves 36 and 38 and for the pump zone 37 as well as in the nature of positioning members. The fastener apertures 60 are also mirrored in the gaskets 65 and 67.

In order to enhance the quality of the seals and to protect the material of the extension portion 22 the gaskets 65 and 67 are provided with O-rings or the equivalent integrally formed portions in the vicinity of said first valve 36, said second valve 38 and said pumping zone 37. The edges of the gaskets 6$ and 67 adjacent to the fluid flow passages 3$ are hardened to provide increased protection.

The pump housing 62 includes a plurality of pneumatic connectors 68 which, as seen in FIG. 1, are connected to associated pneumatic tubes 70 which are in turn connected to a remote pneumatic control apparatus 72 adapted to open and close the first and second valves 36 and 38 and to operate the pump 37 within the pump assembly 12. A variety of pneumatic passages 74 are also formed within the pump housing to connect the pneumatic tubes 70 to the interior of the housing 62.

As shown in FIG. 3, the first pump half 64 includes a first valve depression 76 formed in the lower surface thereof at the location to receive the first valve bubble 40 of the bag assembly 14. The first valve depression 76, with the opposing surface of the second pump half 66, forms a first valve chamber 78. The first valve chamber 78 provides a volume within which the flexible membrane of the first valve bubble 40 may expand and contract. A first pneumatic passage 80 connects the first valve chamber 78 to a first pneumatic connector 82. The application of positive pneumatic pressure through the first pneumatic passage 80 to the first valve chamber 78 will act to force the portions of the first valve bubble 40 together, as shown in phantom in FIG. 3, to occlude the first valve bubble 40 in such a manner that fluid passage through the first valve chamber is eliminated or restricted, depending on the degree of pressure. It is noted that it is not necessary to have a depression, corresponding to the first valve depression 78, in the second pump half 66 since a flat surface is sufficient to accomplish the closure of the first valve 36.

As is seen in the illustration of FIG. 3, the portions of the first passage segment 38 and the second passage segment $o directly surrounding the first valve bubble 42 are provided with rigid reinforcing tubes 84. The rigid reinforcing tubes 84, which are attached by welds 28s to the interior of the bag liner 26, act to prevent the various fluid flow passages 36 from collapsing or becoming occluded for any reason, including the mechanical pressure applied by the first pump half 64 and the second pump half 66 on the filter and fluid bag assembly 14. Similar rigid reinforcing tubes 84 are also utilized on the opposite side of the pump assembly 12 in the vicinity of the second valve bubble 52.

The second valve bubble 52 is situated within a similar cavity as the first valve bubble 40. In this instance the first pump half 64 includes a second valve depression 86 which forms a second valve chamber 88 with the corresponding flat surface of the second pump half 66. The second valve chamber 88 is connected by a second pneumatic passage 90 to a second pneumatic connector 92. The function of the second valve 38 is similar to that of the first valve 36. In FIG. 3, in phantom, for the purposes of illustration, it is shown as if negative pneumatic pressure is being delivered through the second pneumatic passage 90, thus deforming the second valve bubble $2 upward into the second valve depression 86. This insures that the second valve 38 remains open.

The pumping and filtering of the fluid within the self-enclosed filter pump system 10 occurs within a central pump chamber 94, which is formed between the first pump half 64 and the second pump half 66. The pump chamber 94 is formed by an upper depression 96 formed in the first pump half 64 and a corresponding lower depression 98 formed in the second pump half 66. The upper depression 96 is connected by a third pneumatic passage 100 to a third pneumatic connector 102, while, correspondingly, the lower depression 98 is connected by a fourth pneumatic passage 104 to a fourth pneumatic connector 106 Pneumatic control of the pressure in the pump chamber 94 is accomplished by coordinated delivery of positive or negative pneumatic pressure to the third pneumatic passage 100 and the fourth pneumatic passage 104. In the illustration of FIG. 3, no pneumatic pressure is being delivered and the pump/filter bubble 46 is shown as being undeformed. However, it may be readily understood that negative pneumatic pressure will cause the pump/filter bubble 46 to expand outward into the upper and lower depressions 96 and 98 while positive pneumatic pressure will cause the pump/filter bubble 46 to collapse inward toward the filter membrane 48.

The manner in which the filter membrane 48 is attached within the pump/filter bubble 46 is important to the operation of the self enclosed filter pump system 10. In the illustration of FIG. 3 it may be seen that one edge of the filter membrane 48 is attached to the upper portion of the bag liner 26 at the edges of the pump/filter bubble 46 while the opposite edge filter membrane 48 is attached to the lower portion. This construction ensures that fluid entering the pump chamber 94 from the second passage segment 44 must pass through the filter membrane 48 in order to be delivered outward through the third passage segment 50 and eventually to the outlet port 56.

Various methods of securing the first pump half 64 to the second pump half 66 may be utilized. The only requirement is that the first valve chamber 78, the second valve chamber 88 and the pump chamber 94 be pneumatically isolated from the environment and that the interconnection be sufficiently rigid to hold the various elements of the self-enclosed filter pump system 10 together. One alternative, which is illustrated in phantom in FIG. 3, is to utilize a pair of bolt connectors 108 which extend through bolt tubes 110 in the pump housing 62. A fastening nut 112 on one end of the bolt connector 108 is tightened until a complete seal is achieved between the pump halves 64 and 66 so that the pneumatically operated valve and pump chamber are sealed and can operate appropriately. The fastener apertures 60 shown in FIG. 2, are provided for just this fastening method, with the bolt connectors 108 passing therethrough.

An alternate fastening method is illustrated in FIG. 1 wherein the pump shell 62 is shown to be provided along one edge with a clam shell hinge 114 connecting the first pump half 64 to the second pump half 66. A latch mechanism 116, shown in phantom in FIG. 1, is provided on the opposite face of the pump housing 62 to fasten the pump housing 62 into a closed position when desired. An advantage of the clam shell fastening method is that it is very easily and quickly opened and closed for changing of filter and fluid bag assemblies 14. An advantage of the bolt connector method of fastening the pump halves 64 and 66 together is that more precise adjustments of fastening may be achieved by tightening the fastening nuts 112 so that a better seal may be achieved in some instances. Both of these fastener methods, and others, are envisioned.

Figure 4:
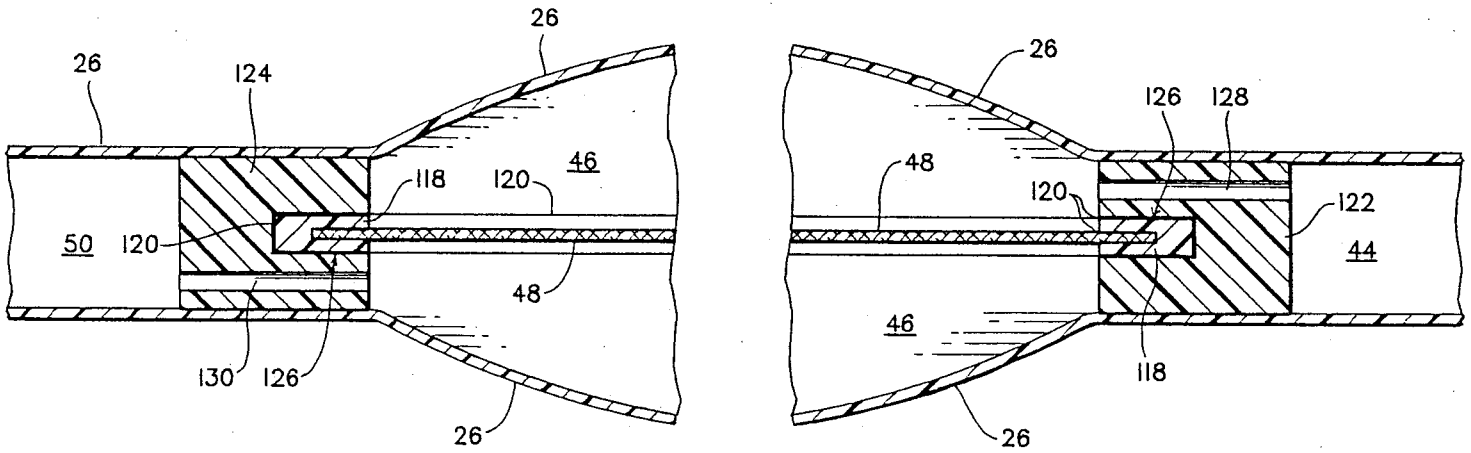
FIG. 4 is a cross-sectional detail view, similar in orientation to that of FIG. 3, broken to show the detail of an alternate filter mounting structure within the pumping bubble.

An alternate method of ensuring that the fluid passes through a filter membrane 48 during the pumping process is illustrated in FIG. 4, in a detail cross-sectional view. This alternate method allows the filter membrane 48 to extend directly across the pump bubble 46 while still forcing the fluid 16 to pass through the filter 48 in order to reach the outlet port 56.

In the alternate embodiment of FIG. 4, the filter membrane 48 is bonded at its peripheral edge to an edge ring 118 by an adhesive 120 or a weld 28. The edge ring 118 is selected to be thicker than the filter membrane 48 and is also sturdier to facilitate attachment to other elements. The edge ring 118 is bonded directly to the bag liner 26 about the periphery of the pump/filter bubble 46 except in the vicinities where the fluid 16 enters and exits the pump bubble 46. At these locations the edge ring 118 is adhered to a first block 122 situated at the entering end of the second passage segment 44 and to a second block 124 at the end of the third passage segment 50. The first block 122 and the second block 124 are, in turn, bonded to the bag liner 26.

The first and second blocks 122 and 124 are essentially Similar solid cylinders having a slot 128 formed in their interior faces to receive the edge ring 118. However, the first block 122 is provided with a first offset tube 128 and the second block 124 is provided with a second offset tube 130 to permit fluid 16 to flow therethrough. The solid blocks are sealed to the bag liner 26 in such a manner that the only fluid entrance to the pump bubble 46 from the second fluid passage segment 44 is through the first offset tube 128. Similarly, the only eXit from the pump bubble 46 to the third fluid passage segment 50 is through the second offset tube 130. The first and second blocks 122 and 124 are arrayed such that the first offset tube 128 and the second offset tube 130 are situated on opposite sides of the filter membrane 48. This ensures that all fluid reaching the outlet port 56 has first passed through the filter membrane 48 so that only filtered fluid is delivered to the desired destination.

In the preferred embodiment 10 the pump shell 62 is constructed of cast aluminum metal and the filter and fluid bag assembly 14 is constructed of Teflon TM. For a typical application such as a photoresist having a 20 cps viscosity 20 the filter membrane is a 0.2 mil Teflon membrane manufactured by Millipore Corporation. A typical capacity of the storage chamber 34 is one liter. Other materials, dimensions and capacities may be utilized at the user's discretion for specific applications.

One variety of pneumatic control apparatus 72 which may be utilized with the preferred embodiment of the self enclosed filter pump system 10 is the commercially available Mariner pump system from for Advanced Control Engineering, Inc., of Santa Clara, Calif. Other pump control systems such as those available from Millipore Corporation and others may also be utilized.

Various other modifications and alterations of the system and assemblies may be made without departing from the invention. Those skilled in the art will readily recognize additional embodiments and uses. Accordingly, the above disclosure is not to be construed as limiting and the appended claims are to be interpreted as encompassing the entire spirit and scope of the invention.

INDUSTRIAL APPLICABILITY

The self-enclosed filter pump system 10 of the present invention and alternate embodiments thereof are adapted to be utilized with conventional pneumatic controls and fluid delivery components. They are of particular use in the semiconductor manufacturing industry, biochemical processing applications and food product mixing apparatus. The pneumatic pumping and valve systems utilized in conjunction with the pump system 10 are well adapted for controlling fluids of a very wide variety of chemical properties and viscosities.

The operation of the self-enclosed filter pump system 10 of the present invention is substantially as follows. The user will have the pump assembly 12 connected by the series of pneumatic tubes 70 to the pneumatic control apparatus 72. The pneumatic control apparatus 72 will be deactivated and the pump assembly 12 will be open such that the first pump half 64 and the second pump half 66 are separated. This may be accomplished either by opening the clam shell embodiment or by loosing the fastening nuts 112 and separating the pump halves.

The filter and fluid bag assembly 14 is then selected for the particular usage and is hung from the hanger 18 or other apparatus by the hanger aperture 32. The extension portion 22 is placed within the pump assembly 12 such that the first valve bubble 40, the pump/filter bubble 46, and the second valve bubble 52 are respectively situated in alignment with the first valve chamber 78, the pump chamber 94, and the second valve chamber 88.

Once the extension portion 22 has been properly aligned the pump housing 62 is closed and the selected fastener method is tightened such that a proper seal is achieved in the pneumatic valve and pump chambers. The outlet port 56 is then either directed to the desired destination or connected by any of a variety of selected methods to additional tubing. The first and second fluid restriction clamps 42 and 58 are then removed and the pump system 10 is ready for pumping operation.

It is noted that in some instances the first fluid restriction clamp 42 will not be in place prior to use. This arrangement is desirable when it is useful to have the filter membrane 48 prewetted by the fluid 16 prior to operation. In some instances, especially where the fluid is of a nature that it is unlikely to cause any deterioration of the filter membrane 48 or to leak past the second fluid restriction clamp 58, it is desirable to prevent the filter in order to save time upon changing of the filter and fluid bag assemblies 14.

When it is desired to pump quantities of the fluid 16 to the outlet port 56, the first valve bubble 40 is opened by applying negative pneumatic pressure to the first pneumatic passage 80 while the second valve bubble 52 is kept closed by positive pneumatic pressure through the second pneumatic passage 90. The internal volume of the filter/pump bubble 46 is increased by applying negative pneumatic pressure to the third and fourth pneumatic passages 100 and 102. This, coupled with the action of gravity, since the filter and fluid bag assembly 14 is hung from the hanger fixture 18, will cause the fluid 16 to flow into the pump/filter bubble 46. When the pump/filter bubble 46 has been filled to the desired degree, the first valve bubble 40 is occluded by positive pneumatic pressure applied through the first pneumatic passage so. The second valve bubble 52 is then opened by applying negative pneumatic pressure to the second pneumatic passage 90. The fluid 16 is then pumped through the filter membrane 48 to the outlet port 56 by applying positive pneumatic pressure to the fourth pneumatic passage 104 and the third pneumatic passage 100 (While continuing pressure through the fourth passage 104). In some instances it may be desirable to apply the positive pneumatic pressure to the fourth pneumatic passage 104 prior to applying the pressure to the third pneumatic passage 100. This will be useful in first driving the fluid 16 through the filter membrane 48 and then pumping the fluid 16 through the third and fourth passage segments 50 and 52 to the outlet port 56.

The amount of fluid 16 to be delivered in a single pumping stroke is determined by the capacity of the pump/filter bubble 46 and the degree of pneumatic pressure, both positive and negative, applied to the pump chamber 94. This will ordinarily be empirically determined and the pneumatic control apparatus 72 will be programmed to deliver the desired amount of the fluid 16 to the outlet port 56.

The above process may be repeated as many times and with whatever frequency is desired by the user, until the contents of the storage chamber 34 are depleted. At this point the pump shell 62 may be opened, the filter and fluid bag assembly 14 may be replaced, and the entire process may be repeated.

It is noted that the nature of the fluid 16 utilized is entirely dependent on the particular filter and fluid bag assembly 14 selected. The pump assembly 12 may be utilized with any of a wide variety of filter and fluid bag assemblies 14. In this manner the same pump assembly 12 may be utilized to input any number of desired components to the final mixture.

Since the self enclosed filter pump system 10 of the present invention and various conceivable alternative embodiments thereof are particularly adapted to create numerous advantages in pumping filtered fluids, it is expected that a wide market will exist therefor. This will be especially true in the semiconductor manufacturing industry, chemical mixing applications, biomedical applications and food processing technology. The system is particularly well adapted for pumping precise amounts of uncontaminated volatile, reactive or varying viscosity materials to desired destinations. The adaptability of the system to different types of fluids create substantial advantages. Accordingly, the commercial viability and industrial applicability of the invention is expected to be substantial and widespread.

I claim:

1. A fluid pumping system comprising:

a pump shell including a series of pump passages connecting (a) a first location on the exterior of said shell to a first valve cavity, (b) said first valve cavity to a pumping cavity, (c) said pumping cavity to a second valve cavity and (d) said second valve cavity to a second location on the exterior of said shell, a plurality of pneumatic passages connecting said first and second valve cavities and said pumping cavity to respective pneumatic connectors on the exterior of said shell, and pneumatic isolation means for isolating said first and second pneumatic cavities and said pumping cavity from each other and from the surrounding atmosphere;

a one piece unitary fluid bag assembly for insertion into the pump shell, including a container portion for enclosing fluid and an extension portion, said extension portion including a series of fluid flow passages connecting (a) said container portion to a first valve bubble, (b) said first valve bubble to a pump bubble, (c) said pump bubble to a second valve bubble, and (d) said second valve bubble to an outlet port, said fluid flow passages and said bubbles corresponding to said respective pump passages and said cavities of the pump shell and being adapted to mate therewith; and pneumatic means for selectively delivering positive and negative pneumatic pressure to said first and second valve cavities so as to selectively occlude and open said first and second valve bubbles to correspondingly prevent and permit fluid flow therethrough, and for delivering positive and negative pneumatic pressure to said pump cavity so as to contract and expand said pump bubble in a controlled manner to pump controlled quantities of fluid therethrough.

2. The pumping system of claim 1 wherein said pumping bubble includes therewithin filter means arrayed such that fluid may only pass from said first valve bubble to said second valve bubble by passing through said filter means.

3. The pumping system of claim 2 wherein said filter means is in the form of a semipermeable membrane.

4. The pumping- system of claim 1 wherein the pump shell includes a first half and second half said first and second halves being adapted to be mated together by attachment means.

5. The pumping system of claim 4 wherein said attachment means includes a pair of bolt connectors extending through said pump halves.

6. The pumping system of claim 4 wherein said attachment means includes a hinge element and an opposing latch.

7. The pumping system of claim 4 wherein said pneumatic isolation means includes a first gasket adjacent to said first pump half and a second gasket adjacent to said second pump half, said gaskets being formed to mate with each other and with said extension portion of the fluid bag assembly so as to form therewith a pneumatic seal.

8. The pumping system of claim 1 wherein said fluid flow passages are structurally reinforced so as to prevent collapse thereof except at selected locations.

9. The pumping system of claim 8 and further including a plurality of restriction clamps for use in collapsing and closing said fluid flow passages at selected locations and occasions.

10. The pumping system of claim 1 wherein the fluid bag assembly further includes;

an exterior structural bag wall; and an interior bag liner; and weld means bonding said bag liner to itself and to said bag wall in such a manner that said fluid contacts only said bag liner during normal usage.

11. The pumping system of claim 1 wherein the fluid bag further includes hanger attachment means by which the fluid bag may be suspended from an external support such that gravity assists the flow of said fluid through the device.

12. In an apparatus for pumping controlled quantities of selected fluids, the improvement comprising:

forming a plurality of fungible one piece unitary fluid bag assemblies, each including a storage chamber adapted to be filled with one of the selected fluids and a pump mating portion including valve bubble means which may be occluded and closed by application of external pressure thereto, and pump bubble means which may be expanded and contracted in a controlled manner by application of positive and negative external pressure so as to pump the selected fluid therethrough, and a fluid pathway connecting said storage chamber to an exit port through said valve bubble means and said pump bubble means; and providing a pump component which may be opened for inserting and interchanging the fluid bag assemblies and closed for operation, the pump component including receiving cavities for receiving associated ones of said valve bubble means and said pump bubble means, channel means for receiving at least a portion of said fluid pathway and pressure means for selectively applying said external pressure to said valve bubble means and said pump bubble means during operation.

13. The improvement of claim 12 wherein said storage chamber is formed to be flexible such that it collapses inward as fluid is removed therefrom.

14. The improvement of claim 12 wherein said valve bubble means includes a first valve bubble and a second valve bubble; and said pump bubble means includes a pumping bubble situated on said fluid pathway intermediate said first and said second valve bubbles.

15. The improvement of claim 14 wherein said pumping bubble includes therewithin a filter component separating said fluid pathway into an unfiltered segment including said storage chamber and a filtered segment including said exit port.

16. The improvement of claim 15 wherein said filter component is aligned substantially perpendicularly to the direction of said expansion and contraction of said pumping bubble, such that said filter component does not interfere with said expansion and contraction and further such that a maximal surface area thereof is accessed by fluid in said unfiltered segment.

17. The improvement of claim 15 wherein said filter component is in the form of a disk bonded to the interior of said pumping bubble and sealed thereto.

18. The improvement of claim 14 wherein said pump component includes a pump shell formed of two mating halves which may be secured together so as to form a pressure seal therebetween about said fluid pathway; and said pressure means includes a plurality of pneumatic passages formed in said pump shell independently connecting the exterior thereof to said receiving cavities associated with said first and second valve bubbles and said pumping bubble, pneumatic control means for selectively providing positive and negative pneumatic pressure and pneumatic connectors for interconnecting said pneumatic passages and said pneumatic control means.

19. The improvement of claim 15 wherein said filter component is a disk-shaped filter peripherally bonded to said pumping bubble such that the entrance of said fluid pathway to said pumping bubble from said first valve bubble lies on one side of said filter while the fluid pathway exit from said pumping bubble to said second valve bubble lies on the opposite side of said filter.

20. The improvement of claim 19 wherein said disk-shaped filter includes a radially interior filter membrane and a radially exterior annular edge ring, said edge ring being bonded to the fluid bag assembly at the edges thereof;

a first block is provided at said entrance said first block receiving a portion of said edge ring and having a first offset tube formed therethrough, said first offset tube lying in said unfiltered segment, said first block prohibiting fluid passage into said pumping bubble except through said first offset tube; and a second block is provided at said exit, said second block being essentially similar to said first block, said second block including a second offset tube to permit fluid flow therethrough only within said filtered segment.

* * * * *